US008919827B2

(12) United States Patent
Akizuki et al.

(10) Patent No.: US 8,919,827 B2
(45) Date of Patent: Dec. 30, 2014

(54) VEHICLE DOOR LOCK DEVICE

(75) Inventors: Ryujiro Akizuki, Kariya (JP); Takashi Nishio, Kariya (JP); Yusuke Yamada, Chiryu (JP); Sho Sannohe, Chiryu (JP); Kazunori Kojima, Aichi-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 655 days.

(21) Appl. No.: 13/142,013

(22) PCT Filed: Mar. 23, 2010

(86) PCT No.: PCT/JP2010/055490

§ 371 (c)(1),
(2), (4) Date: Jun. 24, 2011

(87) PCT Pub. No.: WO2010/110468

PCT Pub. Date: Sep. 30, 2010

(65) Prior Publication Data

US 2011/0260476 A1 Oct. 27, 2011

(30) Foreign Application Priority Data

Mar. 24, 2009 (JP) ..... 2009-071607

(51) Int. Cl.

| | |
|---|---|
| ***E05C 3/06*** | (2006.01) |
| ***E05B 81/06*** | (2014.01) |
| ***E05B 81/16*** | (2014.01) |
| ***E05B 81/36*** | (2014.01) |
| *E05C 3/00* | (2006.01) |
| *E05B 85/02* | (2014.01) |

(52) U.S. Cl.

CPC ..... *E05B 81/06* (2013.01); *E05B 81/16* (2013.01); *E05B 81/36* (2013.01); *E05B 85/02* (2013.01)

USPC ..... 292/201; 292/216

(58) Field of Classification Search

USPC ..... 292/201, 216

See application file for complete search history.

(56) References Cited

U.S. PATENT DOCUMENTS 5,028,084 A 7/1991 Fukumoto et al.
6,003,910 A * 12/1999 Dupont et al. ..... 292/201

(Continued)

FOREIGN PATENT DOCUMENTS

DE 196 11 972 A1 10/1996
EP 1 884 610 A2 2/2008

(Continued)

OTHER PUBLICATIONS

International Search Report (PCT/ISA/210) issued on Jul. 6, 2010, by Japanese Patent Office as the International Searching Authority for International Application No. PCT/JP2010/055490.

(Continued)

*Primary Examiner* — Carlos Lugo

(74) *Attorney, Agent, or Firm* — Buchanan Ingersoll & Rooney PC

(57) ABSTRACT

A vehicle door lock device includes an opening mechanism, a lock mechanism, and an electric actuator. The electric actuator includes an electric motor driven in accordance with a lock operation and an unlock operation, a worm provided integrally with an output shaft of the electric motor, the worm being rotated and driven by the electric motor, and a locking lever having a sector gear meshed with the worm, the locking lever being linked with an active lever. The locking lever is provided with an operation portion linked with a lock knob L provided on the indoor side of a door.

9 Claims, 6 Drawing Sheets

(56) References Cited

U.S. PATENT DOCUMENTS

| | | | | |
|---|---|---|---|---|
| 6,019,402 | A * | 2/2000 | Arabia et al. | 292/216 |
| 6,053,543 | A * | 4/2000 | Arabia et al. | 292/201 |
| 6,279,361 | B1 * | 8/2001 | Baukholt et al. | 70/279.1 |
| 6,474,704 | B1 * | 11/2002 | Rathmann et al. | 292/201 |
| 6,913,298 | B2 * | 7/2005 | Inoue | 292/216 |
| 6,945,574 | B2 * | 9/2005 | Hayakawa et al. | 292/201 |
| 6,951,355 | B2 * | 10/2005 | Hayakawa et al. | 292/201 |
| 7,559,586 | B2 * | 7/2009 | Fukunaga et al. | 292/216 |
| 7,798,539 | B2 * | 9/2010 | Hayakawa et al. | 292/216 |
| 8,029,028 | B2 * | 10/2011 | Akizuki et al. | 292/201 |
| 8,146,965 | B2 * | 4/2012 | Akizuki et al. | 292/201 |
| 8,151,610 | B2 * | 4/2012 | Fujihara | 70/278.7 |
| 8,267,444 | B2 * | 9/2012 | Akizuki et al. | 292/201 |
| 8,276,949 | B2 * | 10/2012 | Akizuki et al. | 292/201 |
| 8,333,414 | B2 * | 12/2012 | Takayanagi et al. | 292/201 |
| 8,474,887 | B2 * | 7/2013 | Suzuki et al. | 292/201 |
| 8,522,583 | B2 * | 9/2013 | Cumbo et al. | 70/279.1 |
| 2001/0038211 | A1 * | 11/2001 | Hayakawa et al. | 292/201 |
| 2002/0117863 | A1 * | 8/2002 | Shinkawa | 292/216 |
| 2004/0036298 | A1 * | 2/2004 | Hayakawa et al. | 292/216 |
| 2005/0167991 | A1 * | 8/2005 | Yoneyama | 292/201 |
| 2006/0186676 | A1 | 8/2006 | Fukunaga et al. | |
| 2007/0075552 | A1 * | 4/2007 | Hayakawa et al. | 292/216 |

FOREIGN PATENT DOCUMENTS

| | | | |
|---|---|---|---|
| GB | 2 360 324 | A | 9/2001 |
| JP | 2-030869 | A | 2/1990 |
| JP | 2001-271531 | A | 10/2001 |
| JP | 2006-266026 | A | 10/2006 |
| JP | 2007-138602 | A | 6/2007 |
| WO | 98/33998 | A1 | 8/1998 |

OTHER PUBLICATIONS

Written Opinion (PCT/ISA/237) issued on Jul. 6, 2010, by Japanese Patent Office as the International Searching Authority for International Application No. PCT/JP2010/055490.

European Supplementary Search Report dated Oct. 29, 2014 issued in the corresponding European Patent Application No. 10756263.9-1503/2412903 (4 pages).

* cited by examiner

VEHICLE DOOR LOCK DEVICE

FIELD OF THE INVENTION

The present invention relates to a vehicle door lock device.

BACKGROUND OF THE INVENTION

One of vehicle door lock devices includes an open mechanism adapted to be actuated in such a manner that a vehicle door is openable relative to a vehicle body, a lock mechanism provided with an active lever capable of driving a lock/unlock member (open link) placed in the open mechanism at a locking position (lock position) or an unlocking position (unlock position), the lock mechanism for restraining or permitting an action of the open mechanism so as to lock or unlock the door, an electric actuator for driving the lock/unlock member (open link) at the locking position (lock position) or the unlocking position (unlock position) through the active lever, and a housing accommodating the open mechanism, the lock mechanism, and the electric actuator. Such a device is shown in Japanese Patent Application Publication No. 2006-266026, for example.

In the vehicle door lock device described in the above patent document, as shown in FIG. 6, an electric actuator 3 for driving an open link 2 (lock/unlock member) at a locking position (lock position) or an unlocking position (unlock position shown in FIG. 6) through an active lever 1 (lock lever in the above patent document) is provided with an electric motor 3*a* driven in accordance with a lock operation and an unlock operation, a worm 3*b* provided integrally with an output shaft of the electric motor 3*a*, the worm being rotated and driven by the electric motor 3*a*, and a worm wheel 3*c* having a pair of engagement projections 3*c*1, 3*c*2 linked with the active lever 1 to be meshed with the worm 3*b*. The pair of engagement projections 3*c*1, 3*c*2 is provided on a side surface of the worm wheel 3*c* and selectively engageable with a concave portion 1*a* provided in the active lever 1.

In the electric actuator 3 shown in FIG. 6, the electric motor 3*a* rotates and drives the worm 3*b*, so that the worm wheel 3*c* is rotated and driven. By rotation of the worm wheel 3*c*, the pair of engagement projections 3*c*1, 3*c*2 is selectively engaged with the concave portion 1*a* provided in the active lever 1, so that the active lever 1 is actuated and the open link 2 is driven at the unlocking position (unlock position) shown in FIG. 6 or the locking position (lock position) (not shown).

SUMMARY OF THE INVENTION

In the above electric actuator 3 in FIG. 6, there is a need for arranging the worm wheel 3*c* in such a manner that the pair of engagement projections 3*c*1, 3*c*2 provided in the worm wheel 3*c* is selectively engaged with the concave portion 1*a* provided in the active lever 1. Thus, arrangement of the worm wheel 3*c* is restricted, and arrangement of the electric motor 3*a* and the worm 3*b* is also restricted. Although a desired reduction ratio can be obtained between the worm 3*b* and the worm wheel 3*c*, the arrangement of the pair of engagement projections 3*c*1, 3*c*2 (position in the radial direction) is restricted by size (diameter) of the worm wheel 3*c*, and thus it is difficult to obtain a desired reduction ratio between the worm wheel 3*c* and the active lever 1. Thereby, downsizing of the door lock device is sometimes restricted.

The present invention is achieved in order to solve the above problems, and characterized by including an open mechanism adapted to be actuated in such a manner that a vehicle door is openable relative to a vehicle body, a lock mechanism provided with an active lever capable of driving a lock/unlock member placed in the open mechanism at a locking position or an unlocking position, the lock mechanism for restraining or permitting an action of the open mechanism so as to lock or unlock the door, an electric actuator for driving the lock/unlock member at the locking position or the unlocking position through the active lever, and a housing accommodating the open mechanism, the lock mechanism, and the electric actuator, the electric actuator including an electric motor driven in accordance with a lock operation and an unlock operation, a worm provided integrally with an output shaft of the electric motor, the worm being rotated and driven by the electric motor, and a locking lever having a sector gear meshed with the worm, the locking lever being linked with the active lever.

In the vehicle door lock device according to the present invention, the electric actuator is provided with the electric motor, the worm, and the locking lever. In the electric actuator, the electric motor rotates and drives the worm, so that the sector gear is rotated and driven to tilt the locking lever. By tilting of the locking lever, the active lever is actuated, so that the lock/unlock member is driven at the locking position (lock position) or the unlocking position (unlock position).

In the vehicle door lock device according to the present invention, tilting of the locking lever having the sector gear is transmitted to the active lever. Thus, by appropriately setting an arm length of the locking lever (arm length up to the active lever), a freedom degree of arrangement of the locking lever can be increased, and a freedom degree of arrangement of the electric motor and the worm can also be increased. The arm length of the locking lever can appropriately be set without being restricted by size of the sector gear. Thus, a desired reduction ratio can be obtained between the locking lever and the active lever. Thereby, downsizing of the door lock device can be achieved.

Upon implementation of the present invention described above, the locking lever may be provided with an operation portion adapted to be linked with a lock knob provided on the indoor side of the door, the lock knob being operable to set the lock/unlock member at the locking position. In this case, an operation lever (operation lever 4 shown in FIG. 6) linking the lock knob provided on the indoor side of the door with the active lever can be eliminated (functions of two parts of the worm wheel and the operation lever in the above patent document can be performed by one part of the locking lever of the present invention). The number of constituent parts of the lock mechanism is reduced, so that the downsizing and cost reduction of the door lock device can be achieved.

Upon the implementation of the present invention described above, the locking lever may be rotatably assembled into the housing, and provided with an engagement portion having a predetermined arm length to be coupled to the active lever. The active lever may rotatably supported on the housing, and provided with a first engagement portion to be coupled to the locking lever and a second engagement portion to be coupled to the lock/unlock member, and retain the lock/unlock member at the locking position or the unlocking position by a position retaining member acting between the active lever and the housing. The active lever may include a main lever rotatably assembled into a support shaft provided in the housing, provided with the first engagement portion, and engaged with the position retaining member, a sub lever rotatably assembled into the support shaft, and provided with the second engagement portion, and a twisted spring placed between the main lever and the sub lever.

DETAILED DESCRIPTION OF THE INVENTION

Figure 3:
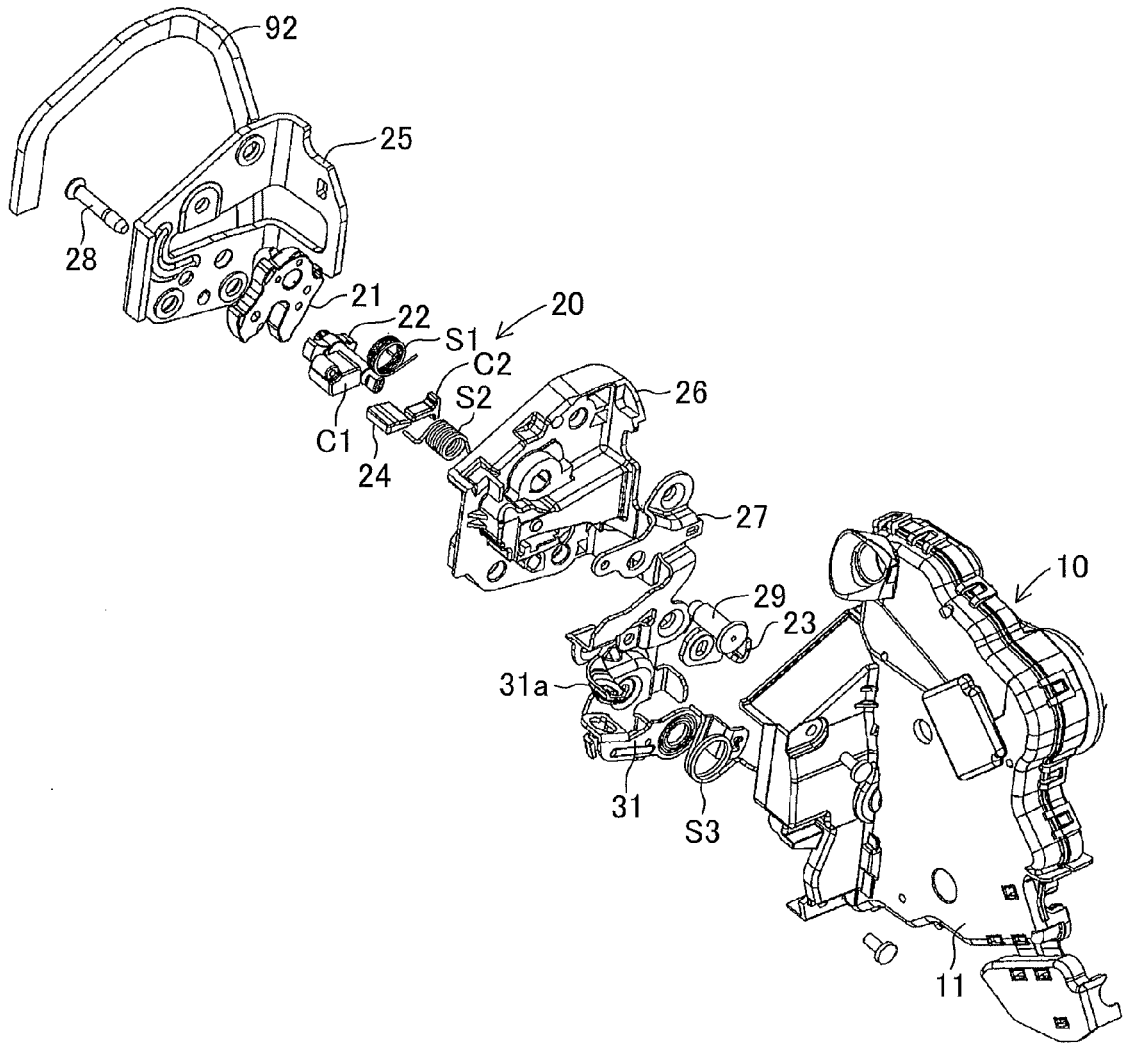
FIG. 3 is an exploded perspective view of part of an open mechanism and a latch mechanism in the vehicle door lock device shown in FIGS. 1 and 2.
Figure 4:
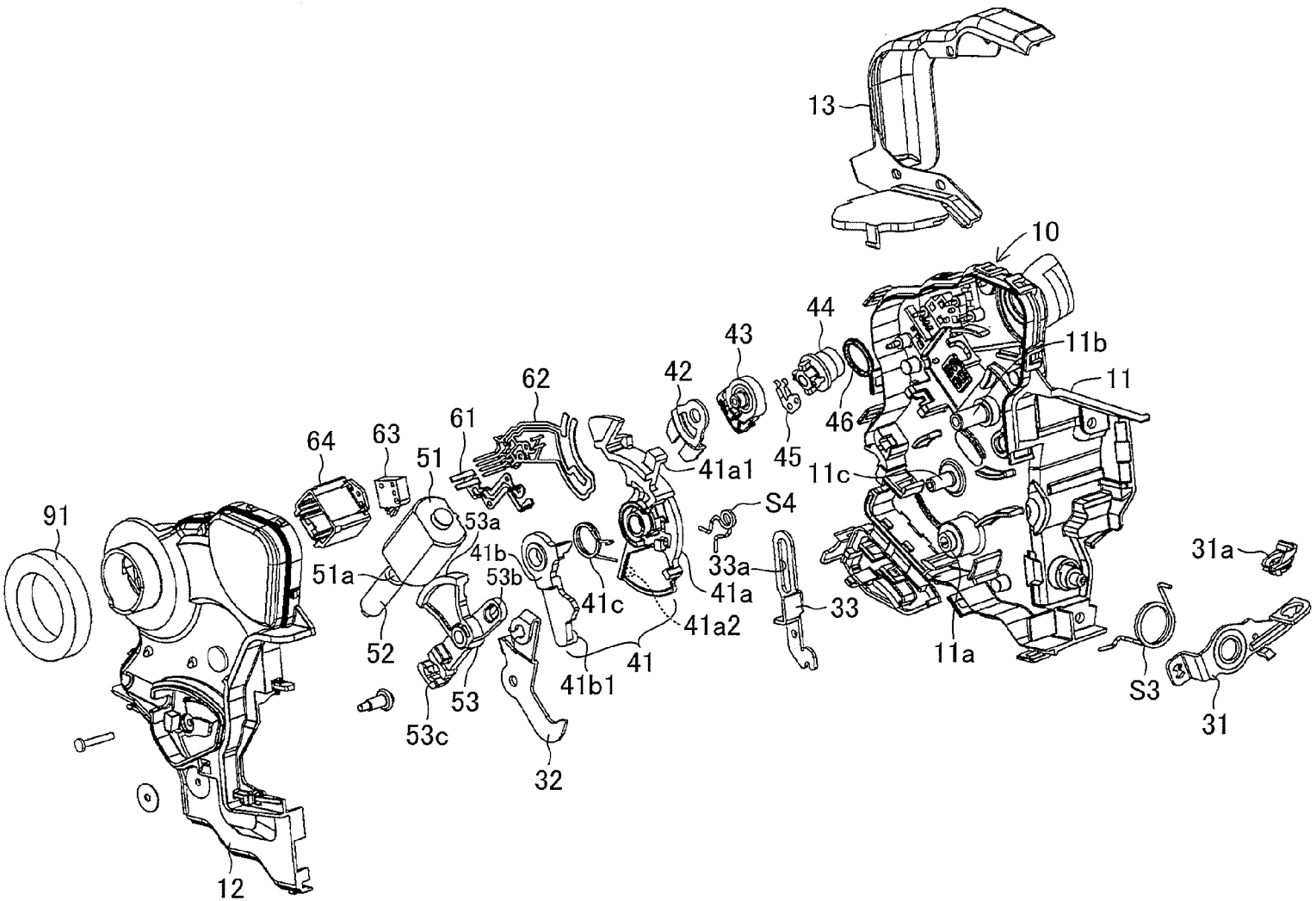
FIG. 4 is an exploded perspective view of the open mechanism, a lock mechanism, and an electric actuator in the vehicle door lock device shown in FIGS. 1 and 2.
Figure 5:
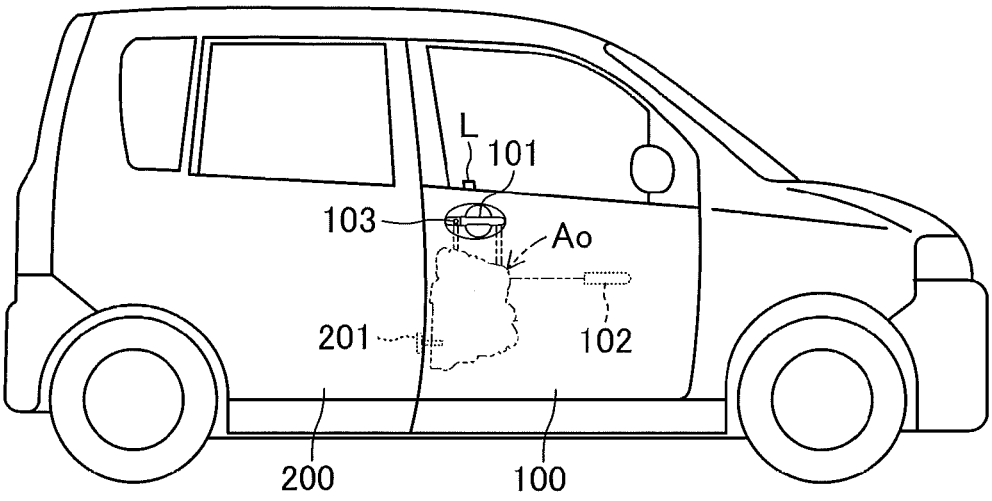
FIG. 5 is a right side view of a vehicle including the vehicle door lock device shown in FIGS. 1 to 4.

Hereinafter, an embodiment of the present invention will be described based on the drawings. FIGS. 1 to 5 show a vehicle door lock device Ao according to the present invention. The vehicle door lock device Ao is installed in a door 100 mounted on the front right side of a vehicle, and as shown in FIGS. 1 to 4, provided with an open mechanism A1, a lock mechanism A2, an electric actuator A3, and a housing 10 accommodating the open mechanism A1, the lock mechanism A2, and the electric actuator A3. As shown in FIG. 4, the housing 10 is provided with a housing body 11, a housing cover 12 assembled into the housing body 11, and a protector 13 assembled into the housing body 11 and the housing cover 12. It should be noted that a seal ring 91 is assembled into the housing cover 12.

The open mechanism A1 is to actuate a known latch mechanism 20 (refer to FIG. 3) from a latch state to an unlatch state in such a manner that the vehicle door 100 is openable relative to a vehicle body 200. The latch mechanism 20 is to retain the vehicle door 100 in a closed state relative to the vehicle body 200 (state where the door 100 is closed), provided with a latch 21 engageable with and disengageable from a striker 201 fixed to the vehicle body 200. It should be noted that the latch mechanism 20 is not shown in FIGS. 1 and 2 but shown in an exploded state in FIG. 3, and assembled into the door 100 in a state where the latch mechanism is assembled into the housing 10.

The latch mechanism 20 is engaged with the striker 201 so as to retain the door 100 in the closed state (latch state). With the door 100 in the closed state, the latch mechanism 20 is disengaged from the striker 201, so that the door 100 is switched from the closed state to an opened state (state where the door 100 is openable relative to the body 200) (unlatch state). As shown in FIG. 3, the latch mechanism 20 is provided with the latch 21, a pole 22, a lift lever 23, and a stopper 24, and also provided with cushions C1, C2, a latch torsion spring S1, and a pole torsion spring S2. These constituent parts are assembled into a base plate 25, a case 26, and a sub base plate 27 by means of a screw 28 and a pin 29. It should be noted that the base plate 25 is assembled into the door 100 through a seal member 92.

The open mechanism A1 is provided with an outside open lever 31, an inside open lever 32, and an open link 33 (lock/unlock member of the present invention). The outside open lever 31 is assembled into the housing body 11 together with a torsion spring S3, linked with an outside handle 101 provided on the outdoor side of the door 100, and actuated by operating the outside handle 101. It should be noted that a clip 31*a* (refer to FIGS. 3 and 4) is assembled into the outside open lever 31.

The inside open lever 32 is rotatably assembled into a support shaft 11*a* provided in the housing body 11, linked with an inside handle 102 provided on the indoor side of the door 100, and actuated by operating the inside handle 102. The open link 33 is movably coupled to and supported on the outside open lever 31 at a lower end thereof, and movable between an unlock position shown in FIG. 1 and a lock position shown in FIG. 2 by an active lever 41 serving as a constituent part of the lock mechanism A2. The open link 33 is engageable with the lift lever 23 of the latch mechanism 20 at the unlock position shown in FIG. 1 so that the door 100 is in the opened state, and non-engageable with the lift lever 23 of the latch mechanism 20 at the lock position shown in FIG. 2.

Figure 1:
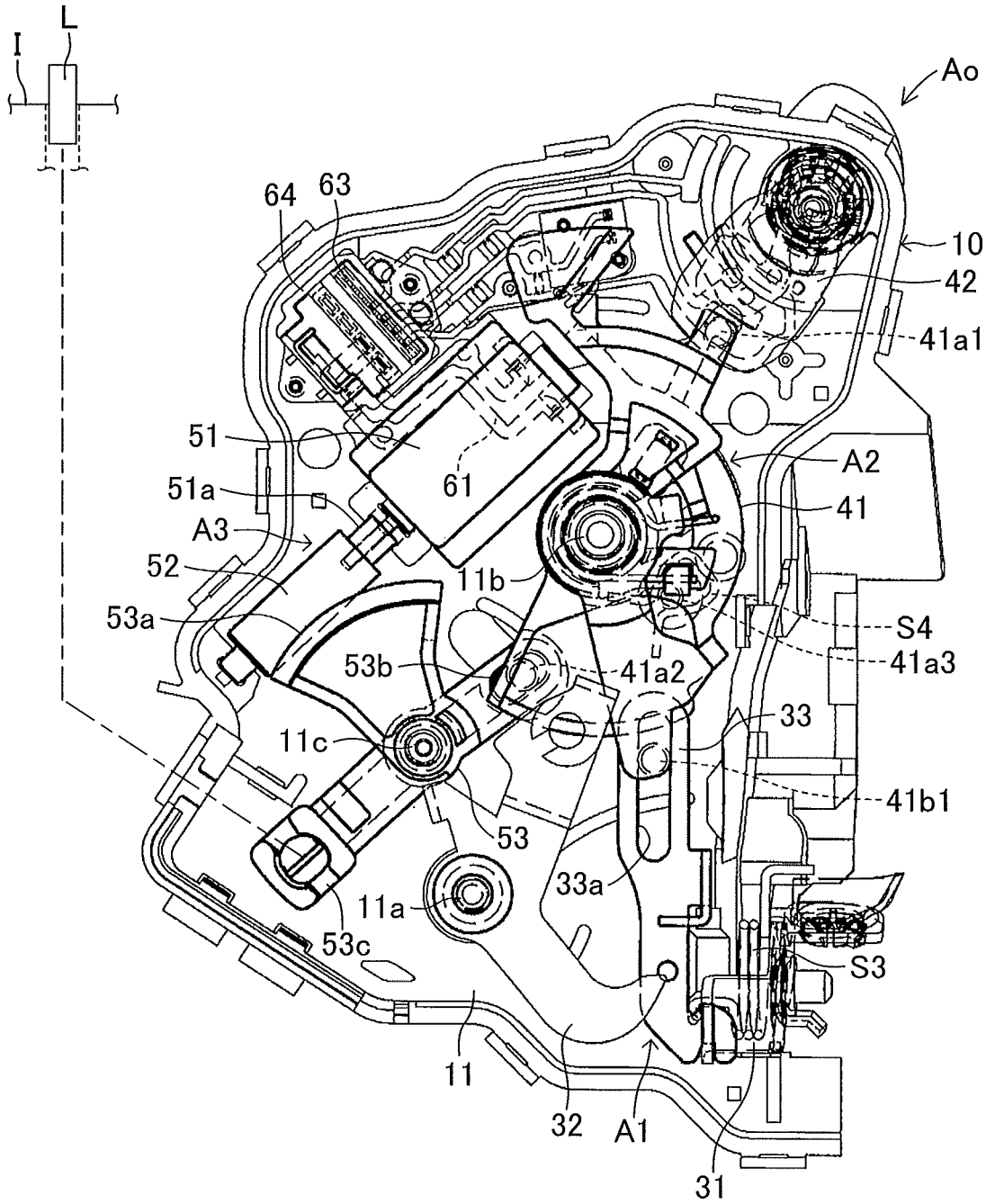
FIG. 1 is a structural view of major parts in an unlock state showing one embodiment of a vehicle door lock device according to the present invention.
Figure 2:
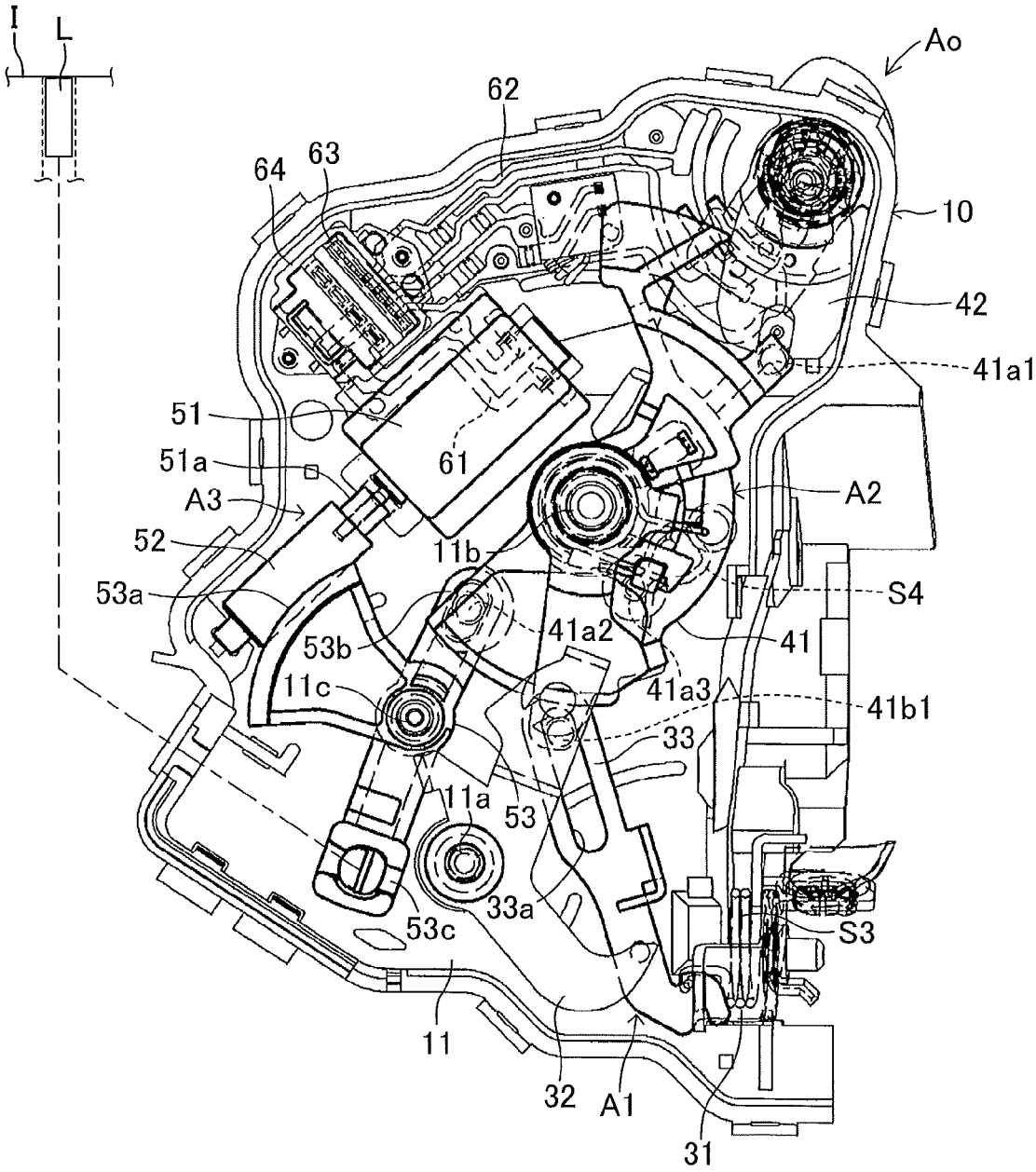
FIG. 2 is a structural view of the major parts in a lock state of the vehicle door lock device shown in FIG. 1.

The open link 33 is moved from the positions shown in FIGS. 1 and 2 in the upward direction of the device (toward the upper side in FIGS. 1 and 2) upon receiving an action of the outside open lever 31 (operation of the outside handle 101) or receiving an action of the inside open lever 32 (operation of the inside handle 102). Therefore, in the case where the open link 33 at the unlock position (unlocking position) shown in FIG. 1 with the door 100 in the closed state is moved in the upward direction upon receiving the action of the outside open lever 31 or the inside open lever 32, the lift lever 23 of the latch mechanism 20 is pushed by the open link 33 and rotated, so that the latch mechanism 20 is actuated from the latch state to the unlatch state. Thereby, the door 100 is switched from the closed state to the opened state. That is, when the open link 33 is at the unlock position in FIG. 1, the door 100 is unlocked.

Meanwhile, in the case where the open link 33 at the lock position (locking position) shown in FIG. 2 with the door 100 in the closed state is moved in the upward direction upon receiving the action of the outside open lever 31 or the inside open lever 32, the open link 33 is not engaged with the lift lever 23 of the latch mechanism 20, so that the latch mechanism 20 is maintained in the latch state. Thereby, the door 100 is maintained in the closed state. That is, when the open link 33 is at the lock position in FIG. 2, the door 100 is locked.

The lock mechanism A2 is to restrain or permit an action of the open mechanism A1 so as to lock or unlock the door, provided with the above active lever 41, and also provided with a locking control lever 42 for driving the above open link 33 at the lock position or the unlock position through the active lever 41, a key switch lever 43, an outside locking lever 44, a contact 45, a seal ring 46, and the like (refer to FIGS. 1, 2, and 4).

The active lever 41 is assembled into a support shaft 11*b* provided in the housing body 11 together with a torsion spring S4 (refer to FIGS. 1, 2, and 4), and rotatably supported on the support shaft 11*b*. As shown in FIG. 4, the active lever 41 is provided with a main lever 41*a*, a sub lever 41*b*, and a twisted spring 41*c*.

As shown in FIGS. 1, 2, and 4, the torsion spring S4 is assembled into the housing body 11, and engaged with an engagement pin 41*a*3 provided in the main lever 41*a*. The torsion spring S4 acts to retain the open link 33 (lock/unlock member of the present invention) at the unlock position in FIG. 1 or the lock position in FIG. 2 between the housing body 11 (housing 10) and the main lever 41*a* (active lever 41).

The main lever 41*a* is rotatably assembled into the support shaft 11*b*. The main lever 41*a* has an engagement portion 41*a*1 (refer to FIG. 1) linked with the locking control lever 42, and also has an engagement portion (pin portion) 41*a*2 (first engagement portion of the present invention, refer to FIG. 1) linked with the electric actuator A3. The sub lever 41*b* is rotatably assembled into the support shaft 11*b*, and rotatable relative to the main lever 41*a* by a predetermined amount. The sub lever 41*b* has an engagement portion (pin portion) 41*b*1 (second engagement portion of the present invention) linked with a long hole 33*a* of the open link 33.

The twisted spring 41*c* (bias member) is placed between the main lever 41*a* and the sub lever 41*b*, similarly to the twisted spring described in Japanese Patent Application Publication No. 2006-266026, to rotate and bias the sub lever 41*b* in one direction (counterclockwise direction in the figure) relative to the main lever 41*a*. Therefore, the main lever 41*a* and the sub lever 41*b* are integrally rotated in the clockwise direction in the figure (lock direction), and rotated through the twisted spring 41*c* in the unlock direction.

The locking control lever 42 is actuated by a mechanical key operation of a key cylinder 103 provided on the outdoor side of the door 100. The locking control lever 42 is assembled into the housing body 11 together with the key switch lever 43, the outside locking lever 44, and the like, and linked with the engagement portion 41*a*1 of the main lever 41*a* in the active lever 41. Therefore, when the locking control lever 42 is actuated by the mechanical key operation, the active lever 41 is rotated. When rotation of the active lever 41 is transmitted to the open link 33, the door 100 is locked or unlocked.

The electric actuator A3 is to drive the above open link 33 at the lock position or the unlock position through the active lever 41. The electric actuator A3 is provided with an electric motor 51, a worm 52, and a locking lever 53. The electric motor 51 is a known motor driven in accordance with a lock operation and an unlock operation. A first terminal 61, a second terminal 62, a switch 63, a connector 64, and the like are provided for controlling an action of the electric motor 51. The worm 52 is provided integrally with an output shaft 51*a* of the electric motor 51, and rotated and driven by the electric motor 51. The locking lever 53 is rotatably assembled into a support shaft 11*c* provided in the housing body 11.

The locking lever 53 has a sector gear 53*a* meshed with the worm 52, and also has an engagement portion (long hole) 53*b* linked with the engagement portion (pin portion) 41*a*2 of the main lever 41*a* in the active lever 41. Therefore, when the electric actuator A3 is actuated, the locking lever 53 is tilted by drive force of the electric motor 51. In accordance with tilting of the locking lever 53, the active lever 41 is rotated. When the rotation of the active lever 41 is transmitted to the open link 33, the door 100 is locked or unlocked. It should be noted that, in this embodiment, a formation angle of the sector gear 53*a* is substantially 45 degrees, so that an action response property in the case where the electric actuator A3 is actuated (time required for switching between lock and unlock of the door 100) is improved in comparison to an action response property of the electric actuator described in Japanese Patent Application Publication No. 2006-266026.

The locking lever 53 is provided with an operation portion 53*c* linked with a lock knob L provided on the indoor side of the door 100. The operation portion 53*c* is formed so as to be tilted integrally with the sector gear 53*a* and the engagement portion 53*b*. Therefore, when the lock knob L provided on the indoor side of the door 100 (inner trim I) is pushed in from a state in FIG. 1 to a state in FIG. 2 and the operation portion 53*c* is tilted, the engagement portion 53*b* of the locking lever 53 is integrally tilted, and the active lever 41 is rotated. Then, when the rotation of the active lever 41 is transmitted to the open link 33, an unlocking state of the door 100 is switched to a locking state. It should be noted that the sector gear 53*a* is also integrally rotated so as to take the worm 52 and the electric motor 51 around.

In the above vehicle door lock device Ao, the tilting of the locking lever 53 having the sector gear 53*a* is transmitted to the active lever 41. Thus, by appropriately setting an arm length of the locking lever 53 (arm length up to the engagement portion (pin portion) 41*a*2 of the main lever 41*a* in the active lever 41), a freedom degree of arrangement of the locking lever 53 can be increased, and a freedom degree of arrangement of the electric motor 51 and the worm 52 can also be increased. The arm length of the locking lever 53 can appropriately be set without being restricted by size of the sector gear 53*a*. Thus, a desired reduction ratio can be obtained between the locking lever 53 and the active lever 41. Thereby, downsizing of the door lock device Ao can be achieved.

Figure 6:
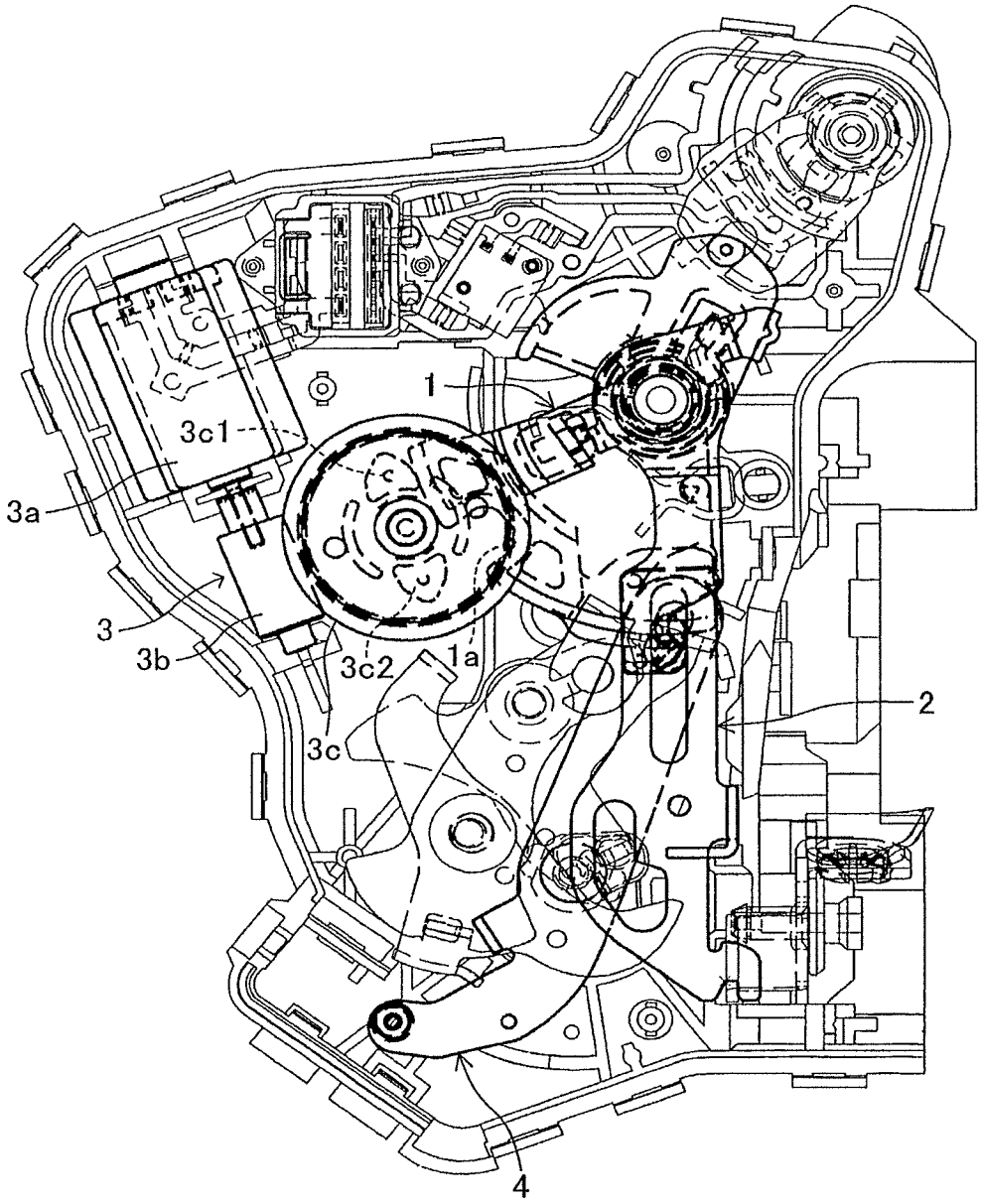
FIG.6 Prior Art
FIG. 6 is a structural view of major parts in an unlock state of a conventional vehicle door lock device.

In the vehicle door lock device Ao, the locking lever 53 having the sector gear 53*a* is provided with the operation portion 53*c* linked with the lock knob L provided on the indoor side of the door 100. Therefore, an operation lever linking the lock knob L provided on the indoor side of the door 100 (inner trim I) with the active lever 41 can be eliminated (functions of two parts of the worm wheel 3*c* and the operation lever 4 shown in FIG. 6 can be performed by one part of the locking lever 53). The number of constituent parts of the lock mechanism A2 is reduced, so that the downsizing and cost reduction of the vehicle door lock device Ao can be achieved.

It should be noted that, in the above vehicle door lock device Ao, when the open link 33 is in the unlock state as in FIG. 1, the lock knob L protrudes from the inner trim I and hence operable, and when the open link 33 is in the lock state as in FIG. 2, the lock knob L is embedded into the inner trim I and hence inoperable. Therefore, by operating the lock knob L, the open link 33 can be switched from the unlock state to the lock state, but can not be switched from the lock state to the unlock state.

In the above embodiment, the lock knob L is adapted to be embedded into the inner trim I when the open link 33 is the lock state (embedding type). However, the lock knob L may be adapted not to be embedded into the inner trim I when the open link 33 is the lock state. In this case, the lock knob L is operable even when the open link 33 is the lock state, and by operating the lock knob L, the open link 33 can be switched from the unlock state to the lock state and also switched from the lock state to the unlock state.

The invention claimed is:

1. A vehicle door lock device, comprising:

an open mechanism adapted to be actuated in such a manner that a vehicle door is openable relative to a vehicle body;

a lock mechanism provided with an active lever rotatably supported by a first support shaft and capable of driving a lock/unlock member placed in the open mechanism at a locking position or an unlocking position, the lock mechanism for restraining or permitting an action of the open mechanism so as to lock or unlock the door;

an electric actuator for driving the lock/unlock member at the locking position or the unlocking position through the active lever; and a housing accommodating the open mechanism, the lock mechanism, and the electric actuator, wherein the electric actuator includes:

an electric motor driven in accordance with a lock operation and an unlock operation;

a worm provided integrally with an output shaft of the electric motor, the worm being rotated and driven by the electric motor; and a locking lever rotatably supported by a second support shaft and having a sector gear meshed with the worm, the locking lever being linked with the active lever, and wherein the first support shaft and the second support shaft are provided on a housing body of the housing;

the locking lever is provided with an operation portion adapted to be linked with a lock knob provided on the indoor side of the door, the lock knob being operable to set the lock/unlock member at the locking position; and the operation portion is provided integrally with the sector gear so as to be rotated integrally with the sector gear.

2. The vehicle door lock device according to claim 1, wherein the locking lever is rotatably assembled into the housing, and provided with an engagement portion having a predetermined arm length to be coupled to the active lever.

3. The vehicle door lock device according to claim 1, wherein the active lever is provided with a first engagement portion to be coupled to the locking lever and a second engagement portion to be coupled to the lock/unlock member, and retains the lock/unlock member at the locking position or the unlocking position by a position retaining member acting between the active lever and the housing.

4. The vehicle door lock device according to claim 3, wherein the active lever includes:

a main lever rotatably assembled into the first support shaft, provided with the first engagement portion, and engaged with the position retaining member;

a sub lever rotatably assembled into the first support shaft, and provided with the second engagement portion; and a twisted spring placed between the main lever and the sub lever.

5. The vehicle door lock device according to claim 1, wherein the first support shaft and the second support shaft are provided in parallel to each other.

6. The vehicle door lock device according to claim 1, wherein the first support shaft and the second support shaft are provided on the same surface in the housing body.

7. The vehicle door lock device according to claim 1, wherein when the operation portion is rotated by an operation of the lock knob, the sector gear is integrally rotated to take the worm around.

8. The vehicle door lock device according to claim 7, wherein the lock knob is configured to be embedded into an inner trim and hence inoperable when the open mechanism is in the lock state.

9. The vehicle door lock device according to claim 1, wherein the lock knob is configured to be embedded into an inner trim and hence inoperable when the open mechanism is in the lock state.

* * * * *